US011528994B2

(12) United States Patent
Chen et al.

(10) Patent No.: US 11,528,994 B2
(45) Date of Patent: Dec. 20, 2022

(54) SEAT FRAME

(71) Applicant: JIAXING REST FURNITURE & APPLICANCE CO., LTD., Zhejiang (CN)

(72) Inventors: Jiguan Chen, Zhejiang (CN); Bing Chen, Zhejiang (CN); Qiangqiang Wu, Zhejiang (CN); Baoli Zhang, Zhejiang (CN); Jianjun Nie, Zhejiang (CN)

(73) Assignee: JIAXING REST FURNITURE & APPLICANCE CO., LTD., Zhejiang (CN)

( * ) Notice: Subject to any disclaimer, the term of this patent is extended or adjusted under 35 U.S.C. 154(b) by 0 days.

(21) Appl. No.: 17/227,172

(22) Filed: Apr. 9, 2021

(65) Prior Publication Data

US 2022/0232978 A1 Jul. 28, 2022

(30) Foreign Application Priority Data

Jan. 25, 2021 (CN) ..... 202110094399.4

(51) Int. Cl.
*A47C 3/18* (2006.01)

(52) U.S. Cl.
CPC ..... *A47C 3/18* (2013.01)

(58) Field of Classification Search
CPC ..... A47C 3/18
See application file for complete search history.

(56) References Cited

U.S. PATENT DOCUMENTS 2,364,516 A * 12/1944 Buckstaff ..... A47C 3/18 248/425
3,572,861 A * 3/1971 Rogers, Jr. ..... A47C 3/18 384/617
5,046,782 A * 9/1991 Lundeen ..... A47C 1/143 108/119
5,479,668 A * 1/1996 Cooper ..... A61N 5/06 5/656
5,779,309 A * 7/1998 Lu ..... A47C 3/18 297/344.26
5,782,451 A * 7/1998 Carnahan ..... A47C 3/18 248/349.1

(Continued)

FOREIGN PATENT DOCUMENTS

CN 107953806 A * 4/2018 ..... B60N 2/14
DE 202009000950 U1 * 4/2009 ..... A47C 3/18
GB 2407028 A * 4/2005 ..... A47C 15/00

*Primary Examiner* — Timothy J Brindley
(74) *Attorney, Agent, or Firm* — Global IP Services; Tianhua Gu

(57) ABSTRACT

The present invention relates to a seat frame, including a lower base; an upper base; and a plurality of rotating devices disposed on the upper base or the lower base and including at least one rotating device capable of horizontally rotating the lower base relative to the upper base. The lower base is connected to the upper base. When the rotating devices make the lower base horizontally rotate relative to the upper base, the upper base and the lower base do not fall off each other. A plurality of connecting devices are disposed on the upper base. The present invention eliminates the noise generated in the rotating process; and a telescopic support enables the size of the seat frame to be adjustable, the installation is simple and convenient, the use effect is good, and it is more stable and is suitable for popularization.

3 Claims, 2 Drawing Sheets

(56) References Cited

U.S. PATENT DOCUMENTS

| | | | | |
|---|---|---|---|---|
| 7,325,875 | B1 * | 2/2008 | Guerrini | A47C 4/52<br>297/344.21 |
| 2011/0163586 | A1 * | 7/2011 | Findlay | A47C 1/0265<br>384/477 |
| 2015/0296987 | A1 * | 10/2015 | Hondros | A47D 1/002<br>297/344.21 |

* cited by examiner

SEAT FRAME

BACKGROUND

Technical Field

The present invention relates to an accessory for sofas and swivel chairs, and in particular, to a seat frame.

Related Art

In the field of functional sofas, a rotating sofa is one of the most widely used forms. Swivel chair seat frames are common accessories in offices. At present, rotating sofas on the market generally use two connection modes: 1. a sofa body is connected to a base through a rotating shaft, thereby realizing the rotation of the sofa; 2. the sofa body is connected through a seat frame, and steel balls in the seat frame roll in a disc track to realize a rotating function of the sofa; and 3. demountable chair feet. The connection modes of the rotating sofa can be selected according to actual style requirements.

The existing seat frame has the following defects:

1. due to the limited radius of a ball track in the seat frame and the influence of easy deformation of balls, the bearing capacity of the seat frame is relatively small;
2. because the rotation is mainly achieved by the rolling of steel columns, when the steel columns rotate, collisions may occur between the balls and between the balls and the seat frame, resulting in noise;
3. the sofa is fixed by the seat frame through surface holes; due to cost and process considerations, the hole size is not adjustable and not very large; and in the preparation of the rotating sofa, the size is limited; and
4. although it is convenient to produce demountable chair feet, it is easy to drop small parts during transportation, which makes the swivel chair unusable.

SUMMARY

The present invention is intended to overcome the defects of the prior art and provides a seat frame for solving the problems of bearing capacity of the seat frame, easy deformation of balls, and noise when rotating.

In order to resolve the technical problems above, the present invention is implemented as follows:

A seat frame, including a lower base; an upper base; and a plurality of rotating devices disposed on the upper base or the lower base and capable of horizontally rotating the lower base relative to the upper base, where the lower base is connected to the upper base; when the rotating devices make the lower base horizontally rotate relative to the upper base, the upper base and the lower base do not fall off each other; and a plurality of connecting devices are disposed on the upper base.

The seat frame, where a center of the lower base and a center of the upper base are provided with bearings and connected to each other, so that the upper base can horizontally rotate relative to the lower base.

The seat frame, where a track for the rotating devices is formed on the lower base, the track is annular, a lower section of the track is kidney-shaped, and the rotating devices roll on a kidney plane, increasing a contact area and improving stability.

The seat frame, where the rotating devices are rollers, and a plurality of rollers are disposed on the upper base.

The seat frame, where the upper base includes two movable supports, which are connected to each other at a central position.

The seat frame, where openings are formed on a surface of the lower base.

The seat frame, where the upper base has a telescopic support, and the upper base is connected to the connecting devices through the telescopic support.

The seat frame, where rolling devices can also be provided in the track of the lower base.

The seat frame, where the structure of the rollers is a structure in which rolling devices are disposed between an inner lining ring and an outer lining ring; the rolling devices may be balls or bearings; an external rubber coating of the bearings reduces noise; and joints between the bearings and the rubber coating are slotted to prevent the rubber coating from falling off.

The seat frame, where an elastic outer wheel shell is wrapped by an outer lining of the rollers.

The present invention has the following beneficial effects: the rotation mode adopted in the present application increases the bearing capacity of the seat frame, and the elastic outer wheel shell is wrapped by the rollers, eliminating the noise generated in the rotating process; and a telescopic support enables the size of the seat frame to be adjustable, the installation is simple and convenient, the use effect is good, and it is more stable and is suitable for popularization.

BRIEF DESCRIPTION OF THE DRAWINGS

The following further describes the present invention in detail with reference to the accompanying drawings and implementations.

DETAILED DESCRIPTION

Figure 1:
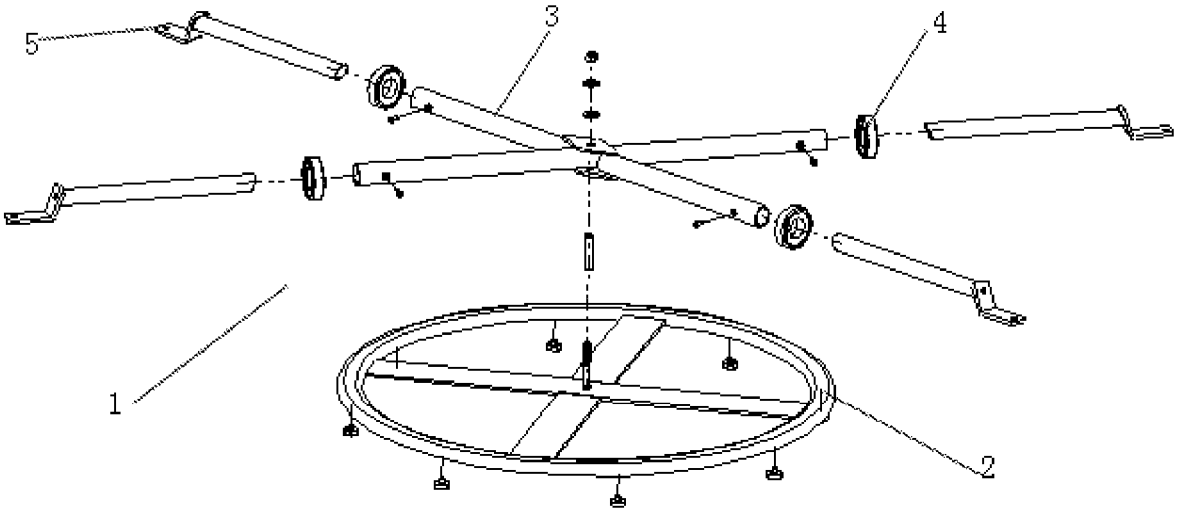
FIG. 1 is a schematic exploded diagram of the present application.
Figure 2:
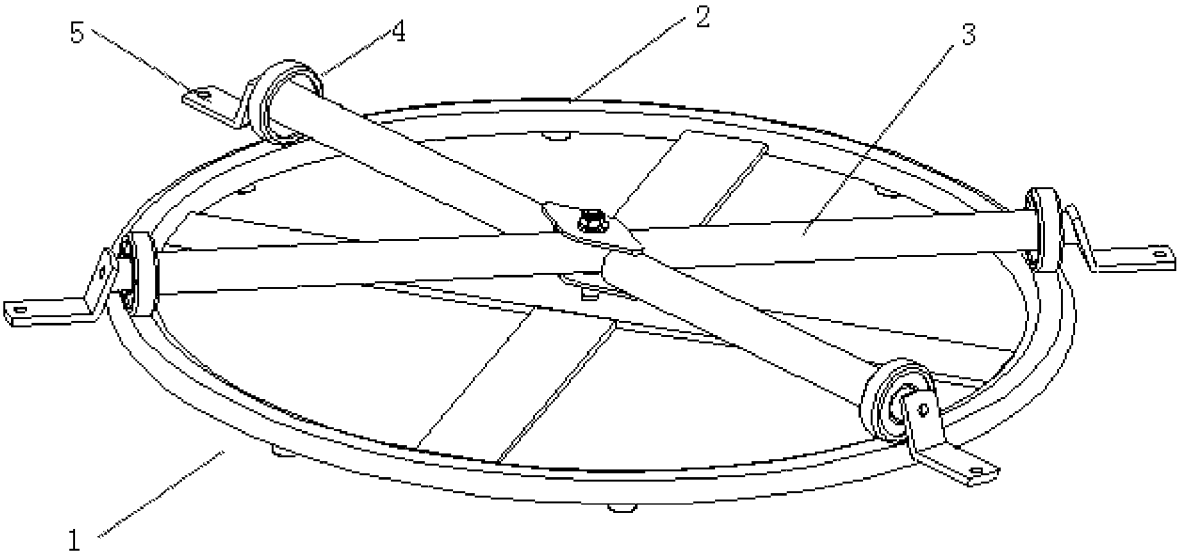
FIG. 2 is a schematic diagram of an overall structure of the present application.
Figure 3:
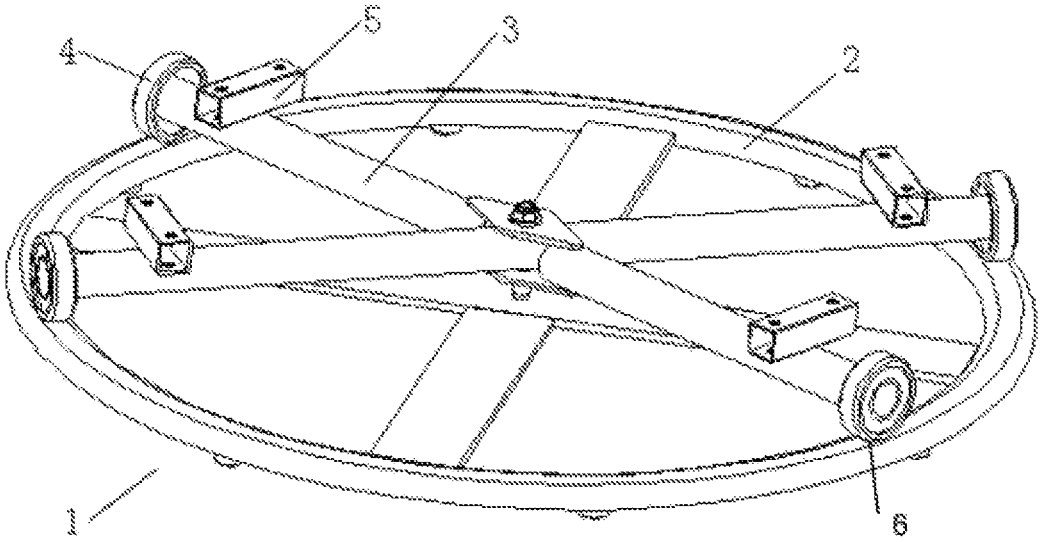
FIG. 3 is a schematic structural diagram illustrating that connecting devices are disposed on the upper part of an upper base.

As shown in FIG. 1, FIG. 2, and FIG. 3, a seat frame 1 includes a lower base 2; an upper base 3; and a plurality of rotating devices 4 disposed on the upper base or the lower base; a center of the lower base and a center of the upper base are provided with bearings and connected to each other, so that the upper base can horizontally rotate relative to the lower base, and the upper base and the lower base do not fall off each other; and a plurality of connecting devices 5 are disposed on the upper base. In use, the upper base 3 and the lower base 2 constitute a main structure of the entire seat frame, and the upper base can move relative to the lower base through a plurality of rotating devices 4 between the upper base and the lower base. As a result, when the lower base is placed on the ground, the rotatable upper base is connected to a sofa seat through the connecting devices 5, so that the entire sofa seat can also rotate relative to the lower base. Compared with the base in the prior art, there is a lower base, there are two upper and lower rolling discs on the lower base, and the bass are disposed in the rolling discs. The lower rolling disc is connected to the lower base, and the upper rolling disc is connected to the sofa seat. Due to the rolling of the balls in the rolling disc, the sofa seat and the lower base can rotate relatively.

In the present application, the lower base is directly used as both the lower base and the lower rolling disc in the prior art at the same time. Components in the prior art are reduced. Moreover, the limitations that the rolling stability depends on the size of the rolling disc and the number of balls in the prior art are solved. The rotating devices of the present application directly roll on the lower base, and the rolling radius is adjusted arbitrarily within the size range of the lower base. Secondly, the rotating devices in the present application are not only limited to the balls in the prior art; rotating devices with higher rolling properties, such as bearings, rollers, etc., can be used. Therefore, the rotating devices are connected to the upper base, and a sofa cushion part to be connected is connected through the connecting devices. In this way, the upper base and the lower base, i.e., a cushion can rotate relatively.

Furthermore, the upper base includes two movable supports, which are connected to each other at a central position; the movable supports are disposed on the lower base through a rotating shaft, and can freely rotate around the rotating shaft; there is a telescopic support in the movable supports, the movable supports are connected to the connecting devices through the telescopic support, and an installation location can be adjusted by the telescopic support. This setting is to adapt to sofa cushions of different sizes, while increasing a rolling arm of the upper base to make the support more stable.

In a modified embodiment, a track for the rotating devices is formed on the lower base, the track is annular, a lower section of the track is kidney-shaped, and the rotating devices roll on a kidney plane, increasing a contact area and improving stability; the rotating devices are rollers, a plurality of rollers are disposed on the upper base, and the rollers move in the track; rolling devices can also be provided in the track of the lower base; the structure of the rollers is a structure in which rolling devices are disposed between an inner lining ring and an outer lining ring; the rolling devices may be balls or bearings; an external rubber coating (6) of the bearings reduces noise; joints between the bearings and the rubber coating are slotted to prevent the rubber coating from falling off; and an elastic outer wheel shell is wrapped by an outer lining of the rollers. By setting a track on the lower base, the rotating devices, i.e., the rollers in this embodiment, roll within a fixed track. As a result, the entire base system is more stable and reliable.

The present invention is not limited to the preferred embodiments above, and simple modifications or equivalent modifications shall fall within the scope of protection of the present invention.

What is claimed is:

1. A seat frame (1) comprising:

a lower base; having an annular recessed track and a rotating shaft located at a center of the annular recessed track;

a upper base constructed by two movable supports which are connected to each other at a central position, two bearings are fixed on two ends of each support respectively, the four bearings of the two movable supports are located in the annular recessed track of the lower base;

the upper base is connected with the lower base through the rotating shaft by a bearing assembly;

two connecting devices are connected to two ends of each movable support through two telescopic supports respectively.

2. The seat frame according to claim 1, wherein the movable support is a first tube with an inside diameter, the connecting device is a second tube with an outer diameter, the inside diameter of the first tube is larger than the outer diameter of the second tube, the second tube is movably inserted into the first tube to form a telescopic support.

3. The seat frame according to claim 1, wherein an external rubber layer is coated on the bearing.

* * * * *